United States Patent [19]

Roberts et al.

[11] Patent Number: 4,690,215

[45] Date of Patent: Sep. 1, 1987

[54] ENHANCED CRUDE OIL RECOVERY

[75] Inventors: George W. Roberts; James G. Hansel, both of Emmaus; Goutam H. Shahani, Allentown, all of Pa.

[73] Assignee: Air Products and Chemicals, Inc., Allentown, Pa.

[21] Appl. No.: 864,179

[22] Filed: May 16, 1986

[51] Int. Cl.[4] ..... E21B 43/243

[52] U.S. Cl. ..... 166/261; 166/256

[58] Field of Search ..... 166/256, 261

[56] References Cited

U.S. PATENT DOCUMENTS

| | | | |
|---|---|---|---|
| 3,024,841 | 3/1962 | Willman | 166/261 |
| 3,170,515 | 2/1965 | Willman | 166/261 |
| 3,174,543 | 3/1965 | Sharp | 166/256 |
| 3,196,945 | 7/1965 | Craig, Jr. et al. | 166/261 |
| 3,999,606 | 12/1976 | Bandyopadhyay et al. | 166/261 X |
| 4,042,026 | 8/1977 | Pusch et al. | 166/261 X |
| 4,454,916 | 6/1984 | Shu | 166/261 X |
| 4,465,135 | 8/1984 | Kamath | 166/261 |
| 4,512,403 | 4/1985 | Santangelo et al. | 166/261 |

FOREIGN PATENT DOCUMENTS

| | | | |
|---|---|---|---|
| 883102 | 10/1971 | Canada | 166/261 |

OTHER PUBLICATIONS

Journal of Petroleum Technology, Jan. 82, C. Chu, pp. 19–36.

Journal of Petroleum Technology, Jul. 84, Shu & Lu, pp. 207–209.

58th Annual Tech. Conf. & Exhibition, Soc. Pet. Engrs., Oct. 83, pp. 2–9, S. L. Lerner et al.

Calif. Reg. Mtg., Soc. of Pet. Engrs., Mar. 82, Paper #10706, J. T. Moss et al.

G. Pusch, (Eerdol und Kohle-Erdgas-Petrochemie, 30(1), 13–25, (1977).

Journal of Petroleum Technology, Jun. 83, pp. 1061–1070, Hvizdos et al.

*Primary Examiner*—George A. Suchfield

*Attorney, Agent, or Firm*—Willard Jones, II; E. Eugene Innis; James C. Simmons

[57] ABSTRACT

Enhanced oil recovery from a crude oil reservoir is promoted following primary oil production, by subjecting the reservoir to water flooding, discontinuing the water flooding, preferably when the remaining oil is at an OIP level above 0.10, and then subjecting the reservoir to fireflooding with gas having an $O_2$ content of at least 50%, preferably above 85%.

4 Claims, No Drawings

ENHANCED CRUDE OIL RECOVERY

FIELD OF THE INVENTION

The present invention relates to methods for increasing recovery of crude oil from an oil reservoir and is particularly concerned with operations wherein following initial primary recovery of available oil from the well by applied or intrinsic pressure, further recovery of oil is obtained by a sequence of secondary and tertiary techniques.

BACKGROUND OF THE INVENTION

In many light oil (32°–40° API) reservoirs and in some medium oil (20°–32° API) reservoirs, most of the original oil in place (OIP) is recovered in three stages. In the initial stage, usually termed primary production, oil either flows from the wells due to the intrinsic reservoir pressure or is pumped from the reservoir. Ordinarily, only a limited quantity of the original OIP can be produced by this method, very roughly 20% of the original OIP. Waterflooding, a secondary recovery technique, is the next stage in this sequence and yields additional oil, very roughly an additional 30%. At about this percentage, the cost of continuing the waterflood usually becomes uneconomical relative to the value of the oil produced. Hence, as much as 50% of the original (OIP) can remain even after a reservoir has been extensively waterflooded. Thus, the need for tertiary recovery which is the final stage in the sequence. This stage may utilize one of several enhanced oil recovery methods; e.g., polymer flooding, $CO_2$ flooding and fireflooding (in-situ combustion).

Fireflooding by in-situ combustion in air has received increased attention as a tertiary recovery process since it offers many distinct technical advantages over attempted competing tertiary oil recovery processes. In this technique, ambient air is pumped into the reservoir which combusts the heavier (least desirable) portions of the crude oil. The heat and gases from combustion pressurize the reservoir and decrease the viscosity of the crude oil by heating and cracking. Additional drive is imparted by the condensing steam from combustion and the hydrocarbon gases that evolve from the cracking reactions.

Fireflooding can be applied to reservoirs having oil gravities ranging from about 10°–40°API. Oils near 40°API often have such high primary and secondary recoveries that the remaining concentration of oil, i.e., the OIP is frequently judged to be so low that air fireflooding would not be technically feasible. The usual range for fireflooding falls between about 12°–32°API. In particular, it has been found that light crude oils (27°API and higher) often deposit insufficient coke to support in-situ combustion in air. Even when sustained, the quality of combustion is often marginal, resulting in the inefficient utilization of oxygen. The presence of high concentrations of water in the oil formation, due to the waterflooding process, aggravates the problem of achieving stable combustion because peak combustion temperature is reduced. Therefore, as proven crude oil reserves have been increasingly depleted, oil field operators have turned to secondary and tertiary recovery techniques to recover additional oil from existing reservoirs. This has often led to an overemphasis of waterflooding at the expense of a subsequent tertiary recovery process such as fireflooding, largely due to the perceived lower cost of waterflooding. As noted above, if the tertiary recovery process is fireflooding, the OIP remaining after extensive waterflooding may be too low for the fireflood to be a technical or economic success. There have been few attempts to optimize the waterflooding/fireflooding sequence even in a semi-quantitative manner. Furthermore, the advantages of using $O_2$ enriched air to fireflood a previously waterflooded field have not previously been recognized.

In present conventional practice, waterflooding is usually continued until the cost per barrel of oil recovered becomes unacceptably high. At this point the field may be abandoned or tertiary oil recovery by in-situ combustion in air may be attempted. If the previous waterflooding has been continued to an extent leaving a low value of oil in place (OIP) remaining (below 0.1), fireflooding by combustion in ambient air has not been found technically or economically practical. Thus, the oil remaining after the waterflood has been generally considered as effectively non-recoverable.

PRIOR ART

A state of the art review of field projects utilizing fireflooding as a technique for enhancing oil recovery is presented by Chu, C. in the Journal of Petroleum Technology, January 1982, at pages 19-36. The author attempts to establish a screening guide to enable prediction of successful fireflooding by air combustion. Based on analyses of 32 projects using air fireflooding, 7 of the 9 technical field failures had OIP values less than 0.10. All of these 7 were medium or light crude oils (API>20°). Only one of the successful operations had an OIP less than 0.10, while the 22 successful fireflood operations were in fields having an OIP greater than 0.10. [OIP represents the decimal volume fraction of the total reservoir that is occupied by the oil. It is determined by taking the void fraction of the reservoir that is not work (porosity, $\phi$) and multiplying by the fraction of the porosity that is oil (oil saturation, $S_o$). The balance of the porous space is water and gas].

An article by Shu, W. R. and Lu, H. S. in Journal of Petroleum Technology, July 1984, pages 207–209, provides laboratory combustion tube data for fireflooding, utilizing 21% $O_2$/79% $CO_2$ as the injected gas. The substitution of $CO_2$ for $N_2$ was chosen to simulate the high concentration of $CO_2$ present in the combustion gas from an $O_2$ fireflood. The oil was a heavy oil (13.4°API) and the OIP was a high value of 0.23. Comparing a combustion tube run with the above $O_2/CO_2$ mixture with a run with air, Shu and Lu concluded that the oxygen utilization improved from 94% to 99%, but other combustion parameters were largely unchanged. In both runs the combustion characteristics were satisfactory.

Lerner, S. L., et al. (Paper No. 12003 presented at the 58th Annual Technical Conference and Exhibition, Society Petroleum Engineers, October 1983, pp. 2–9), provided a computer simulation of an oxygen-enriched combustion process in a light oil (32°API), extensively-water-flooded reservoir. The OIP was a low value of 0.10. The simulated injected gas was 50% $O_2$/50% $CO_2$. Comparative computer runs with air were not made. The computer results, therefore, were inconclusive with regard to the advantages of oxygen enrichment.

Moss, J. T., et al. (Paper No. 10706, presented at the California Regional Meeting, Society of Petroleum Engineers, March 1982) presented the results of combustion tube experiments on heavy oil (12°API) with a high oil-in-place (0.24). Their experiments used air, $O_2$, air+water or $O_2$+water as the injection gas. The simultaneous use of air+water or $O_2$+water is termed "wet combustion" and is distinct from the sequential waterflooding and subsequent fireflooding. These workers concluded that the use of $O_2$ instead of air, either alone or in conjunction with water, provides a faster rate of oil recovery without affecting the $O_2$ utilization efficiency or the combustion temperatures.

Pusch, G. (Erdol und Kohle-Erdgas-Petrochemie, 30(1), 13–25 (1977) published an article dealing with the use of $O_2$ enriched air (80–100% $O_2$) with the simultaneous injection of water for medium and light oils (25°–40°API). In their process, first combustion is initiated with air. Next the $O_2$ concentration is increased to 80–100% $O_2$. At the same time, water is injected at a specific ratio with $O_2$. Finally, $O_2$ injection is suspended and water injection increased.

The first known field tests in which oxygen-enriched air was successfully used in an in-situ combustion process for the enhanced recovery of crude oil were those carried out in 1980 by Air Products and Chemicals, Inc. (assignee of the present invention), described by Hvizdos, L. J., et al. in Journal of Petroleum Technology, June 1983, pp. 1061–1070. Oxygen-enriched air (up to 90% $O_2$) was applied to a small portion of a heavy oil (10°API) reservoir [that had not been previously waterflooded] and which had an OPI of 0.17 at the time of the test. Specific oil productivity from the relevant production wells improved as compared to adjacent wells fireflooded by air combustion.

SUMMARY OF THE INVENTION

It has now been found, in accordance with the present invention, that improved recovery of crude oil is obtained when water flooding of the reservoir is carried out and terminated at an OIP level significantly above that at which conventional water flooding is normally terminated, and fireflooding is initiated at that OIP level employing oxygen enriched combustion gas. It has also been found that the use of oxygen enriched air in place of atmospheric air permits successful fireflooding of previously waterflooded reservoirs, even when waterflooding is continued to an OIP that is normally considered unacceptable for fireflooding.

DETAILED DESCRIPTION OF THE INVENTION

In conventional practice, as earlier indicated, only a limited quantity of the crude oil present in an oil source can be recovered (as up to about roughly 20% of the original oil in the reservoir) by so-called primary production, in which the oil flows from the wells due to intrinsic reservoir pressure or by being pumped from the reservoir. Further recovery of oil is then attained by a secondary recovery technique by flooding the reservoir with water. A portion of the oil remaining after termination of the water flooding stage may then be recovered by a tertiary fireflooding stage using ambient air with greater or less success. The water flooding operation is usually continued to a low OIP level when the cost of recovered oil becomes unacceptably high.

In practice of the present invention the primary production of light oil and water flooding secondary oil recovery may be carried out in heretofore known manner. However, water flooding is preferably discontinued while the OIP is still at a relatively high level, above 0.10, preferably about 0.15 ($\Phi S_o$). Moreover, the subsequent fireflooding is carried out using oxygen-enriched combustion gas, at an $O_2$ volume concentration of at least about 50%, preferably above 85%.

Laboratory combustion tube experiments were conducted with a light crude oil (32°API) on a synthetic rock matrix comprising Ottawa sands. The experiments were done at 750 psig. In one set of runs the oil matrix simulated the reservoir condition at an OIP level of 0.095 and in another set of runs using a matrix simulating a reservoir at an OIP level of 0.16; each of the matrices conforming the reservoirs having been previously water flooded to the respectively indicated OIP levels. For each level of OIP separate combustion tube runs were made with 21% $O_2$ (air) and with 95% $O_2$.

All of the above runs utilized the same quartz sand mix (27% porosity) and the same $O_2$ flux at a burnfront of 22 SCF $O_2$/hr.ft.$^2$. Both runs with the high OIP correspond to an increase of 67% in the oil saturation ($S_o$) in comparison to the two runs at low OIP. The increase in $S_o$ was accompanied by a 60% decrease in the water saturation ($S_w$) so that the gas saturation was held constant at 23%. The fluid saturation is the fraction of the reservoir void volume which is occupied by the fluid (oil, water, gas).

The two combustion tube runs at 95% $O_2$ (vol.) provided strong, satisfactory combustion; whereas, the two corresponding runs with air provided weak generally unsatisfactory combustion. The combustion reaction in the runs with air at both 0.096 and 0.16 OIP died-out after a few hours of burning. This demonstrates that air fireflooding of light-oil reservoirs with high water levels is technically difficult, and accounts for the previously-noted technical failures of most field projects in this category. It also demonstrates the fireflooding with oxygen-enriched air allows a successful recovery of light oil from a reservoir containing high levels of oil.

The results of the two runs with 95% $O_2$ are shown in Table I below:

TABLE I

| | Runs With 95% $O_2$ | |
|---|---|---|
| $S_o$, % | 35 | 60 |
| OIP | 0.095 | 0.16 |
| $O_2$ flux at front SCF $O_2$/hr. ft.$^2$ | 22 | 22 |
| Front vel. ($V_f$) ft./day | 10.9 | 13.2 |
| Max. front temp., °F. | 706 | 692 |
| Coke loading, lb./ft.$^3$ | 1.54 | 1.36 |
| $V_f/O_2$ flux @ front | 0.49 | 0.60 |
| $O_2$ Util. Eff., % | 86 | 93 |
| SCF/$O_2$ Bbl OIP | 3600 | 1750 |

The above measured and calculated parameters reveal that for the same rate of supply of $O_2$ to the burn front, the higher OIP had the following beneficial advantages:

(A) Front velocity increased by 17%

(B) Coke loading decreased by 12%

(C) $O_2$ utilization efficiency increased by 8%

(D) SCF $O_2$/Bbl OIP decreased by 51%

Further, from these runs with high $O_2$ concentration one can expect three advantages in initiating in-situ combustion (fireflooding) while the reservoir is at a relatively high OIP.

(A) The lower coke loadings with the higher OIP will permit more total oil to be available in the reservoir for potential recovery.

(B) The higher front velocities per unit of oxidant at the front would, in turn, require less total oxidant for a fixed well spacing (injector to producer), the higher $V_f/O_2$ (at front) corresponds to less time for the burn-front to reach the producer and thus less total oxidant injected into the reservoir.

(C) The higher front velocities permit quicker oil production.

The air combustion run data are set out in Table II below:

TABLE II

| | Runs With 21% $O_2$ (air) | |
|---|---|---|
| $S_o$, % | 35 | 60 |
| OIP | 0.095 | 0.16 |
| $O_2$ flux at front SCF $O_2$/hr. ft.$^2$ | 22 | 22 |
| Front vel. ($V_f$) ft./D | 8* | 10.7* |
| Coke loading, lb./ft.$^3$ reservoir | 1.3 | 1.2 |
| $V_f/O_2$ flux @ front | 0.36 | 0.48 |
| $O_2$ Util. Eff., % | 61 | 80 |
| SCF air/Bbl OIP | 20,000 | 8,600 |

*Prior to dying out

These data show that in-situ combustion in ambient air is unsatisfactory as a technique for fireflooding to enhance oil recovery from a previous waterflooded field, as compared to use of high oxygen-containing gas.

The compared results of the above-described runs indicate that both combustion and overall process performance are enhanced when (1) combustion gas high in oxygen content is employed in place of air and (2) applied to a previously water flooded reservoir having a relatively high OIP value. The several advantages attained by operation in accordance with the invention include:

(a) lower oxygen required per barrel of oil in place,
(b) lower coke deposition,
(c) higher oxygen utilization efficiency,
(d) higher total oil recovery,
(e) higher front velocity at a given oxygen supply level.

In practice of the invention water flooding should be continued, following primary production, until the OIP is at a level in the range of 0.10 to 0.25, at which level fireflooding is initiated using $O_2$-enriched combustion gas containing 50 to 100% $O_2$, preferably in the range of 85 to 99.5% $O_2$. The invention is particularly adapted for recovery of crude oil having an API gravity in the range of 20° to 40°.

Certain of the beneficial effects of the invention can be realized in treating of previously water flooded reservoirs having an OIP level below 0.1 (but no lower than 0.05) and to which reservoirs further oil recovery by air combustion fireflooding is ordinarily technically or economically inexpedient. In such instances fireflooding may be beneficially utilized, employing gas having an oxygen content above 90%.

The superior combustion of the oil in high concentrations of oxygen in comparison to ambient air cannot be fully explained. Without being bound to any particular theory, the superior behaviour may be related to reaction rate—including reaction kinetics—rather than to just the heat capacity of the nitrogen removed. This, however, leaves without satisfactory explanation the combination of unanticipated lower coke loading and faster front velocity realized at the higher OIP level.

What is claimed:

1. In a process for secondary recovery of an oil field wherein waterflooding proceeds fireflooding, the improvement comprising terminating said waterflooding and initiating said fireflooding prior to achieving an oil in place value (OIP) of at least 0.1 and carrying out said fireflooding with an oxygen enriched atmosphere.

2. The process of claim 1 wherein the oxygen content of said oxygen-enriched air atmosphere is in the range of 85 to 99.5 volume percent oxygen.

3. The process of claim 1 wherein said oil in place value is at least 0.15.

4. In a process for secondary recovery of an oil field wherein waterflooding to an oil in place value (OIP) of less than 0.1 preceeds fireflooding, the improvement comprising carrying out said fireflooding with an oxygen enriched atmosphere wherein the oxygen content is at least 90 volume percent oxygen.

* * * * *

UNITED STATES PATENT AND TRADEMARK OFFICE

CERTIFICATE OF CORRECTION

PATENT NO. : 4,690,215

DATED : September 1, 1987

INVENTOR(S) : Roberts et al

It is certified that error appears in the above-identified patent and that said Letters Patent is hereby corrected as shown below:

Column 6, Line 25

Delete "proceeds" and substitute therefore --preceeds--

Signed and Sealed this

Tenth Day of May, 1988

*Attest:*

*Attesting Officer*

DONALD J. QUIGG

*Commissioner of Patents and Trademarks*